US005152452A

United States Patent [19]

Fendel

[11] Patent Number: 5,152,452

[45] Date of Patent: Oct. 6, 1992

[54] PRESSURE VESSEL AND METHOD

[75] Inventor: Edwin Fendel, Kinnelon, N.J.

[73] Assignee: York Industries, Inc., York, Pa.

[21] Appl. No.: 848,899

[22] Filed: Mar. 10, 1992

[51] Int. Cl.[5] ..... B23K 31/02

[52] U.S. Cl. ..... 228/184; 228/173.4; 228/203; 228/263.15; 228/60; 220/581; 48/179

[58] Field of Search ..... 228/173.4, 184, 203, 228/263.15, 60; 220/581, 584, 900, DIG. 29; 48/179, DIG. 3

[56] References Cited

U.S. PATENT DOCUMENTS

| | | | |
|---|---|---|---|
| 2,319,487 | 5/1943 | Baldwin, Jr. | 228/184 |
| 2,366,617 | 1/1945 | Harris | 220/581 |
| 2,503,190 | 4/1950 | Branson | 220/581 |
| 2,679,454 | 5/1954 | Offenhauer | 75/124 |
| 2,685,546 | 8/1954 | Gibb | 143/16.7 |
| 2,748,464 | 6/1956 | Kaul | 29/535 |
| 2,789,344 | 4/1957 | Kaul | 29/535 |
| 3,246,794 | 4/1966 | Marshall | 220/581 |
| 4,023,696 | 5/1977 | Anagnostidis | 220/3 |
| 4,344,057 | 8/1982 | Stekly et al. | 335/299 |
| 4,663,000 | 5/1987 | Liu | 204/55.1 |

*Primary Examiner*—Samuel M. Heinrich
*Attorney, Agent, or Firm*—Griffin, Branigan & Butler

[57] ABSTRACT

A sheet of work-hardenable, non-heat-treatable, corrosion-resistant steel is cold rolled into a tube (12) and welded (10). The cold rolling strengthens the material. The welding causes the weld area (10) to revert to its annealed condition, but the ends (24, 30) of the tube (12) are then swaged into open domes (14, 16) to form a symmetrically-swaged tube having further work-hardened ends which overcome the apparent weakness of the weld (10). A spherical disk (20) is then welded on to one end to form a bottom and a port section (26) is welded on to the other end to complete the bottle construction.

18 Claims, 1 Drawing Sheet

PRESSURE VESSEL AND METHOD

BACKGROUND

This invention relates to an improved pressure vessel of the type used to contain high pressure fluids.

Particularly in transportation systems such as aircraft, fluid pressure vessels are used to store air or other fluids to provide energy for emergency operation of hydraulic structures such as actuators. Because such systems find their use primarily in emergency situations, they must be fail safe. Accordingly, they must often be checked for structural integrity and freedom from corrosion.

The above-described air reservoirs are customarily made of heat-treatable steel with a wire over-wrap made of the same material. Such reservoirs or "gas bottles" have a limited life of only about fifteen years and, particularly because of the wire over-wrap are subject to corrosion problems. To fight the corrosion problems the bottles must be removed from the aircraft or other vehicle for regular maintenance. In the case of wire-wrap bottles it is necessary to strip off the wire; treat the bottle for corrosion; inspect the bottle for structural integrity; rewrap the bottle; and, test it prior to its return to the aircraft or other vehicle. Because this is an expensive and time consuming process, it is an object of this invention to provide such a pressure vessel that is more easily maintained and will meet the stringent specifications without requiring a wire wrapping.

Because safety is such an important factor—particularly in transportation vehicles—a substantial advantage of the invention is the provision of a more safe pressure vessel. In this respect, the above-discussed wire wrapping is used to reduce shattering of such gas bottles if they are struck such as by gun fire during operation. The vessel and method of the invention provide a structure that does not shatter when subjected to conventional gunfire tests and the vessels of the invention have an "infinite life".

Other advantages of the invention are that no resin coating is required; the vessels of the invention are non-magnetic even after 60% cold working; there is no significant growth in bottle size after pressure cycling; there is no leakage even at extreme temperatures; the vessel can withstand the extreme temperatures of altitude and even cryogenic temperatures; the fabrication method does not significantly affect the physical properties of the material from which the vessels are constructed; and the vessels meet conventional aircraft weight requirements.

SUMMARY

A sheet of work-hardenable, non-heat-treatable, corrosion-resistant steel is cold rolled into a tube and welded. The cold rolling strengthens the material with only the welded section reverting to its annealed condition. The ends of the tube are then swaged into open domes to form a symmetrically- swaged tube having further work-hardened ends; and, the weld section is strengthened sufficiently that there is not a weak-point in the vessel's overall structure. A suitably-shaped disk is then welded on to one end to form a bottom and a port section is welded on to the other end to complete the bottle construction.

BRIEF DESCRIPTION OF THE DRAWINGS

The foregoing and other objects, features, and advantage of the invention will be apparent from the more particular description of preferred embodiments thereof as illustrated in the accompanying drawings wherein the same reference numerals refer to the same elements throughout the various views. The drawings are not necessarily intended to be to scale, but rather are presented so as illustrate principles of the invention in a clear form.

In the drawings.

DETAILED DESCRIPTION

Figure 1:
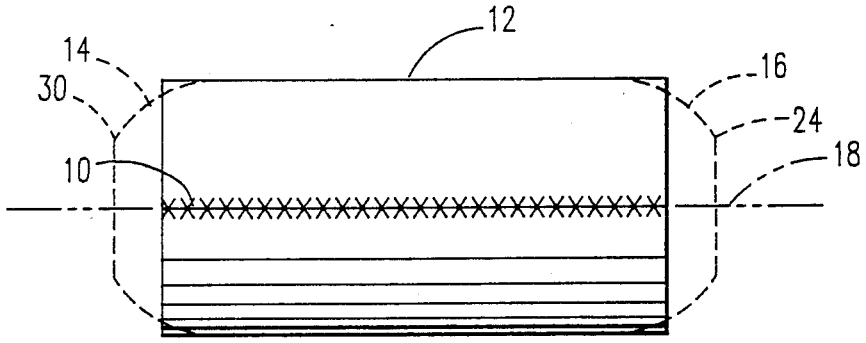
FIG. 1 is a schematic illustration of initial steps of the method of the invention.
Figure 2:
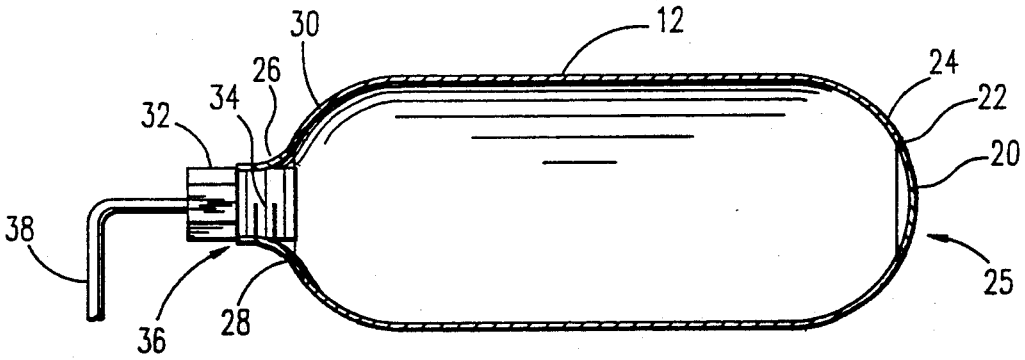
FIG. 2 is a schematic cross-sectional view of a pressure vessel constructed in accordance with the method of the invention.
Figure 3:
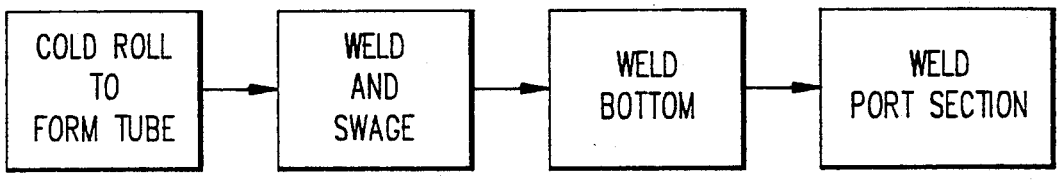
FIG. 3 is a schematic illustration of the steps of the method of the invention.

A flat sheet of work-hardenable, non-heat-treatable, corrosion-resistant steel is cold rolled and welded at 10 to form a tube 12. In a preferred embodiment the sheet is 0.343 cm thick and sized so that the outside diameter is 9.27 cm. Because the material is work hardenable, it is strengthened during the cold rolling step. The weld section 10 reverts to its annealed strength during the welding step but, as noted, this apparent weakness is overcome as the ends of the tube are next swaged, at a force of about 22,680 kg., into open domes as illustrated by dotted lines 14 and 16 in FIG. 1. This cold working sufficiently strengthens the weld area 10 and further strengthens the swaged end areas. It also permits the wall thickness in the swaged area to increase as the diameter is decreased to form the illustrated swaged tube that is essentially symmetrical about axis 18. Because the diameter is reduced and stresses in the dome area are low, it is permissible for the dome-weld areas to remain in the annealed condition.

A suitably-mating spherical or elliptical disk 20 is welded at 22 to the swaged end 24 of the tube 12 to form a bottom portion 25. A port section 26 is welded at 28 to the other swaged end 30 and a suitable fitting such as a hex piece 32 is affixed such as by threads 34 to the port piece 26 to form a port end 36. Port tubing 38 is then suitably affixed to the hex piece 32.

The above-described welding steps can be one of a variety of standard types such as tungsten-inert-gas (TIG) using fusion with no metal added; metal-inert-gas (MIG) where metal is added; electron-beam (E.B.) using plain fusion in a vacuum; or, plasma welding. MIG, however, is the preferred method.

A preferred type of work-hardenable, non-heat-treatable, corrosion-resistant steel is NITRONIC 40, austenitic, nitrogen-strengthened, stainless steel manufactured by the Armco Steel Corporation of Baltimore, Md. The NITRONIC 40 product is described further in Armco Product Data Bulletin S-54 which is further identified as LA-3374 5M BK. 3-74. That publication and the other publications described therein are incorporated herein by reference. Other materials including the austenic stainless steels such as 301, 304, 316, 321, and 347 can be used, but they require a much heavier bottle to meet the same strength requirements and they might be too heavy to meet given aircraft-weight requirements.

The following compositions, among the others mentioned above, are acceptable work-hardenable, non-heat-treatable, corrosion-resistant stainless steels to be used with the invention:

TABLE 1

| ELEMENT | % #1 | % #2 |
|---|---|---|
| Carbon | 0.08 max | 0.040 max |
| Manganese | 8.00–10.00 | 8.00–10.00 |
| Phosphorus | 0.060 max | 0.060 max |
| Sulfur | 0.030 max | 0.030 max |
| Silicon | 1.00 max | 1.00 max |
| Chromium | 19.00–21.50 | 19.00–21.50 |
| Nickel | 5.50–7.50 | 5.50–7.50 |
| Nitrogen | 0.15–0.40 | 0.15–0.40 |

The 0.40% maximum carbon composition should be specified if the pressure vessel is to meet the $CuSO_4$-$H_2SO_4$ test as defined in the requirements of Federal Test Methods Standards 151b, Method ASTM A 393 for stabilized or extra-low-carbon stainless steels.

In a preferred embodiment the spherical disk 20 was also made of NITRONIC 40. The welds 10, 22, and 28 were made of 308L stainless steel. The port piece 26 is preferably from either 304L stainless steel or NITRONIC 40. The hex piece 32 is a conventional steel fitting and the tube 38 is conventional seamless tubing.

The tube 12 and spherical disk 20 were 0.343 cm thick prior to cold rolling and swaging. In one embodiment, the outer diameter of the tube 12 was 9.27 cm; the overall length from the end of the port piece 26 to the bottom of the spherical disk 20 was 19.30 cm; the length of the port piece 26 was 2.54 cm; the outer diameter of the end-most portion of the port piece 26 was 4.45 cm; and, the welds 10, 28, and 22 were specified as being 0.635 cm at 60°. The thusly-dimensioned embodiment had a volume of 819.4 ccm and weighed only 1.344 kg to be in compliance with aircraft weight requirements. Another embodiment was similarly constructed, but dimensioned to form a 491.6 ccm vessel which weighed only 0.952 kg.

The above-described pressure vessel meets the requirements of MIL-R-8573 A, Amendment 7, Type 30-40, Class B which is incorporated herein by reference.

A vessel such as those described above was subjected to the Salt Fog test of MIL-STD-810C which is also incorporated herein by reference. Those tests demonstrated the vessel's corrosion resistance. That is, the 819.4 cc vessel described above was subjected to the Salt Fog Test and showed no evidence of pitting or corrosion as a result of exposure to the Salt Fog environment. During the Salt Fog test the test items were pressurized by hydraulic fluid to 210.92 kg/cm$^2$G. The pressure did not change during the tests which confirmed the absence of leakage; and, there was no evidence of corrosion or stress-corrosion cracking.

Vessels constructed in accordance with the invention were also subjected to normal-temperature leakage tests and extreme-temperature leakage tests without any evidence of leakage either during or after the tests.

Vessels constructed in accordance with the invention were also subjected to cycling tests wherein the internal pressure was variously cycled between 0 and 351.6 kg/cm$^2$G with no change in permanent volumetric expansion after 100,000 cycles.

Embodiments of the invention were also subjected to hydrostatic burst tests wherein the vessels were connected to a supply of hydraulic fluid at 485.12 kg/cm$^2$G for one hour. During such tests there was no rupture or leakage; and, after the test items were vented, they exhibited no deformation or cracking. Similarly, radiographic inspection did not reveal any rejectable defects.

Longitudinal cross sections of vessels of the invention were also taken after testing to determine the adverse effect, if any, on the gas port section 32, the main cylinder 12, and the end closure 20. The test specimen was suitably prepared and etched, but indicated a freedom from defects such as abnormal segregation, pipes, cracks, seams, or abnormal changes of structure throughout the cross section and flow lines.

The material of the tested vessels was subjected to compositional and tensile tests after the above-described tests to determine whether the fabrication processes or the hydrostatic burst tests had any significant affect on the physical properties of the materials. The composition and physical properties continued to meet all requirements and were unchanged from the values measured on a sheet of raw material before the start of the fabrication. In this respect, the composition of one preferred embodiment was as follows:

TABLE 2

| ELEMENT | % By Weight |
|---|---|
| Carbon | 0.03 |
| Manganese | 8.45 |
| Phosphorus | 0.025 |
| Sulphur | 0.007 |
| Silicon | 0.49 |
| Chromium | 21.13 |
| Nickel | 7.02 |
| Nitrogen | 0.31 |

The tensile testing indicated a yield strength at the 0.2% offset of 5237.9 kg/cm$^2$; a tensile strength of 8050.1 kg/cm$^2$; and, an elongation in two inches of 37.5%. In this respect, the endurance limit of the vessels of the invention is 3945 kg/cm$^2$ and the stress calculation for a tested preferred embodiment was only 2647.8 kg/cm$^2$. Hence, in MIL-SPEC parlance, the vessels of the invention had an essentially infinite life. Also, as noted, they had essentially no corrosion and require no maintenance. This is contrasted with corresponding, currently-used gas bottles which have a limited life of only about fifteen years; are additionally subjected to corrosion problems; and, require regular maintenance.

Finally, vessels of the invention were subjected to destructive gun-fire testing in accordance with MIL-R-8573A PARA 4.4.11 to determine the greatest dimensions of entry and exit holes and, perhaps most importantly, whether the vessel would shatter or fragment when subjected to gun-fire. In this respect, each test item was impacted with one round of a 0.50 caliber, M-2, armor-piecing projectile which was yawing approximately 85°–90°. None of the test items, however, exploded or fragmented upon impact; no significant tearing occurred; and, it was demonstrated that the infinite life, corrosion-free vessel of the invention could easily pass the required pressure vessel tests without a requirement for the customary wire winding.

While the invention has been specifically shown and described with reference to preferred embodiments, it will be understood by those skilled in the art that various changes and form in detail may be made therein without departing from the spirit and scope of the invention. The invention has been described, for example in connection with a vessel that is 19.3 cm long and 9.27 cm in diameter, but the fabrication technique of the invention applies to cylinders of any length-to-diameter ratio.

The embodiments of the invention in which an exclusive property or privilege are claimed are defined as follows:

1. A method of making a pressure vessel including the steps of:

forming a tube by work hardening a non-heat-treatable, corrosion-resistant steel;

cold working both ends of said tube to form an open dome on each end;

affixing a bottom portion to a first of said open domes; and, affixing a port section to the other of said open domes to form a pressure vessel that meets the requirements of MIL-R-8573A and MIL-STD-810C without the need for wire winding.

2. The method of claim 1 wherein said tube is formed from a flat sheet of work-hardenable, non-heat-treatable, corrosion-resistant steel.

3. The method of claim 1 wherein said work hardening is obtained by cold rolling.

4. The method of claim 1 wherein said welding steps are performed by a metal-inert-gas method.

5. The method of claim 2 wherein said flat sheet, after work hardening, is welded to form said tube.

6. The method of claim 2 wherein the step of cold working the ends of said tube to form said open domes is accomplished by swaging.

7. The method of claim 1 wherein said bottom portion and said port section are affixed by welding.

8. The method of claim 7 wherein said welding steps are performed by a metal-inert-gas method.

9. The method of claim 1 wherein the step of cold working the ends of said tube to form said open domes is accomplished by swaging.

10. The method of claim 9 wherein said work hardening is obtained by cold rolling.

11. A pressure vessel having a work-hardened generally-cylindrical portion of non-heat-treatable, corrosion-resistant steel, said cylindrical portion having cold-worked, inwardly-directed end portions;

a bottom end portion also of work-hardenable, non-heat-treatable, corrosion-resistant steel welded to one of said end portions; and, a port section welded to the other end of said generally cylindrical portion.

12. The vessel of claim 11 wherein said port section is also comprised of work-hardenable, non-heat-treatable, corrosion-resistant steel.

13. The vessel of claim 11 wherein said non-heat-treatable, corrosion-resistant steel is nitrogen-strengthened.

14. The vessel of claim 11 wherein, in percent by weight, said non-heat-treatable, corrosion-resistant steel consists essentially of:

| | |
|---|---|
| Carbon | 0.040 max |
| Manganese | 8.00–10.00 |
| Phosphorus | 0.060 max |
| Sulfur | 0.030 max |
| Silicon | 1.00 max |
| Chromium | 19.00–21.50 |
| Nickel | 5.50–7.50 |
| Nitrogen | 0.15–0.40 |

15. The vessel of claim 11 wherein the ends of said generally cylindrical tube are swaged to form said open dome.

16. The vessel of claim 11 wherein said bottom end portion is comprised of a spherical disk.

17. The vessel of claim 11 wherein the ends of said generally cylindrical portion are cold formed to modify their cross-sectional thickness and increase their strength.

18. The vessel of claim 17 wherein the cold-formed portions have an increased cross-sectional thickness.

* * * * *